US008791750B2

(12) United States Patent
Wada

(10) Patent No.: US 8,791,750 B2
(45) Date of Patent: Jul. 29, 2014

(54) CONSTANT VOLTAGE CONSTANT CURRENT GENERATION CIRCUIT

(75) Inventor: Masaharu Wada, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 769 days.

(21) Appl. No.: 13/022,888

(22) Filed: Feb. 8, 2011

(65) Prior Publication Data

US 2012/0091803 A1 Apr. 19, 2012

(30) Foreign Application Priority Data

Oct. 14, 2010 (JP) ..... 2010-231209

(51) Int. Cl.
*G05F 1/10* (2006.01)

(52) U.S. Cl.
USPC ..... 327/539; 327/513

(58) Field of Classification Search
USPC ..... 327/539; 323/313
See application file for complete search history.

(56) References Cited

U.S. PATENT DOCUMENTS

| | | | | |
|---|---|---|---|---|
| 5,614,816 | A * | 3/1997 | Nahas | 323/316 |
| 5,666,046 | A * | 9/1997 | Mietus | 323/313 |
| 6,583,611 | B2 * | 6/2003 | Serratoni | 323/313 |
| 6,930,538 | B2 * | 8/2005 | Chatal | 327/539 |
| 7,071,767 | B2 * | 7/2006 | Ou-yang et al. | 327/539 |
| 7,078,958 | B2 * | 7/2006 | Gower et al. | 327/539 |
| 7,224,210 | B2 * | 5/2007 | Garlapati et al. | 327/539 |
| 7,233,195 | B2 * | 6/2007 | Oh | 327/538 |
| 7,768,343 | B1 * | 8/2010 | Sinitsky | 327/539 |
| 7,880,534 | B2 * | 2/2011 | Huang et al. | 327/539 |
| 7,944,283 | B2 * | 5/2011 | Kim et al. | 327/539 |
| 2007/0080740 | A1 | 4/2007 | Berens et al. | |
| 2008/0042736 | A1 * | 2/2008 | Byeon | 327/539 |
| 2008/0061760 | A1 * | 3/2008 | Jeong | 323/313 |

FOREIGN PATENT DOCUMENTS

JP 11-045125 2/1999

* cited by examiner

*Primary Examiner* — Thomas J Hiltunen
(74) *Attorney, Agent, or Firm* — White & Case LLP

(57) ABSTRACT

A constant voltage constant current generation circuit includes a first transistor, a first resistor connected between the first terminal and a second potential, a first diode connected in series with the first resistor, and a first operational amplifier which outputs a first control signal to a control terminal of the first transistor. The constant voltage constant current generation circuit includes a current output circuit which outputs a constant current from a current output terminal according to the first control signal, a second transistor through which a second current flows, the second current obtained by mirroring a first current flowing through the first transistor, a second resistor connected between the voltage output terminal and the second potential. The constant voltage constant current generation circuit includes a current source which outputs a current to the voltage output terminal, and which has negative current characteristics with respect to a temperature change, and a reference voltage output circuit which outputs the reference voltage from a reference voltage terminal.

18 Claims, 4 Drawing Sheets

CONSTANT VOLTAGE CONSTANT CURRENT GENERATION CIRCUIT

CROSS-REFERENCE TO RELATED APPLICATION

This application is based upon and claims the benefit of priority from the prior Japanese Patent Application No. 2010-231209, filed on Oct. 14, 2010, the entire contents of which are incorporated herein by reference.

BACKGROUND

1. Field

Embodiments described herein relate generally to a constant voltage constant current generation circuit which outputs a constant current and a constant voltage.

2. Background Art

For example, each of resistors used in conventional semiconductor integrated circuits has temperature characteristics in which the resistance value changes with the temperature. A BGR (Band Gap Reference) circuit using such resistors can generate only either a constant voltage or a constant current because of alignment in resistance values of the resistors.

In a circuit configuration from which a constant voltage, and a constant current are demanded, therefore, BGR circuits of two kinds respectively for the constant voltage and the constant current become necessary. As a result, a problem of an increased area of the circuit and increased power dissipation is posed.

DETAILED DESCRIPTION

Figure 1:
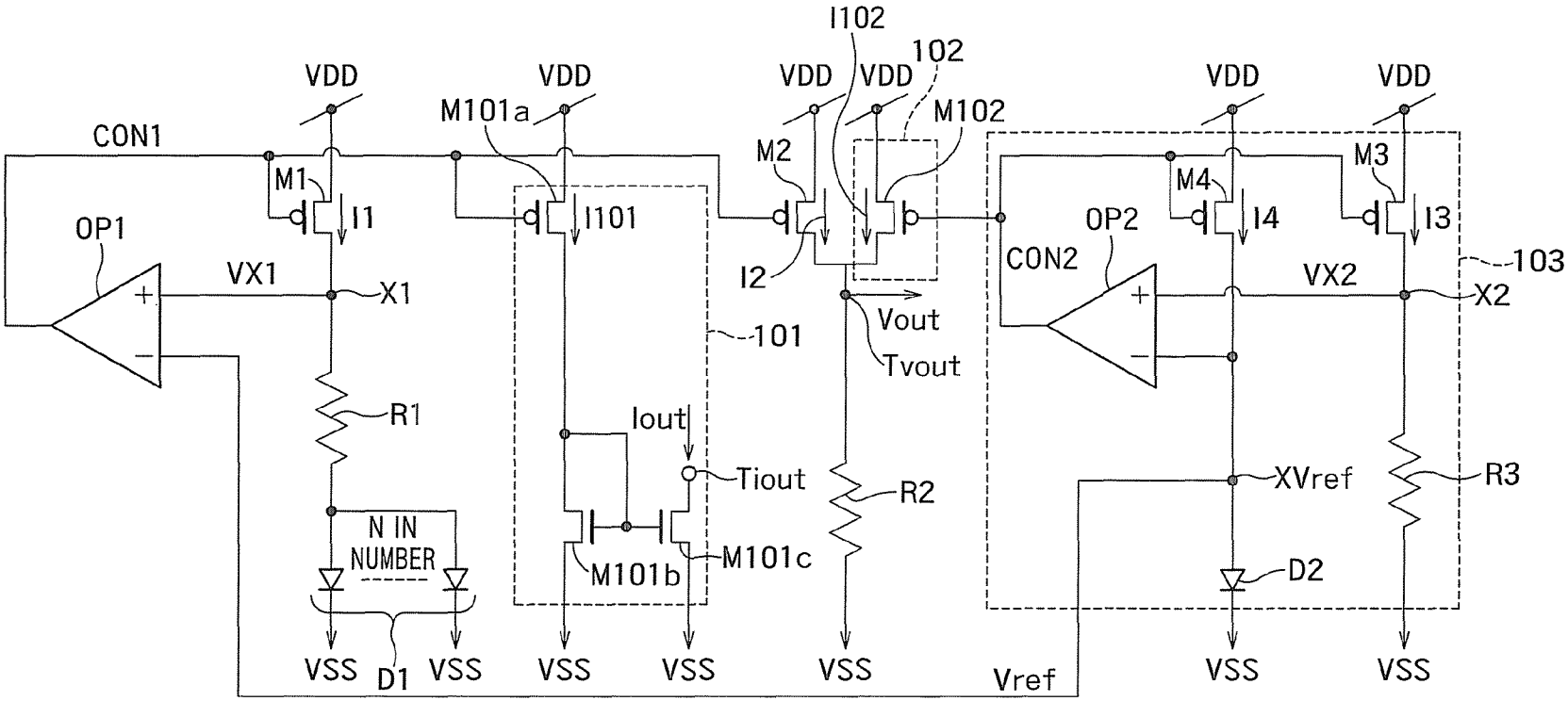
FIG. 1 is a diagram showing an example of a circuit configuration of a constant voltage constant current generation circuit 100 according to a first embodiment.

A constant voltage constant current generation circuit according to an embodiment, includes a first transistor connected at a first end thereof to a first potential and connected at a second end thereof to a first terminal. The constant voltage constant current generation circuit includes a first resistor connected between the first terminal and a second potential. The constant voltage constant current generation circuit includes a first diode connected in series with the first resistor between the first terminal and the second potential. The constant voltage constant current generation circuit includes a first operational amplifier which is supplied with a voltage at the first terminal and a reference voltage, and which outputs a first control signal to a control terminal of the first transistor. The constant voltage constant current generation circuit includes a current output circuit which is connected between the first potential and the second potential, and which outputs a constant current from a current output terminal according to the first control signal. The constant voltage constant current generation circuit includes a second transistor which is connected between a voltage output terminal for outputting a constant voltage and the first potential, which is supplied at a control terminal thereof with the first control signal, and through which a second current flows, the second current obtained by mirroring a first current flowing through the first transistor. The constant voltage constant current generation circuit includes a second resistor connected between the voltage output terminal and the second potential. The constant voltage constant current generation circuit includes a current source which is connected between the first potential and the voltage output terminal, which outputs a current to the voltage output terminal, and which has negative current characteristics with respect to a temperature change. The constant voltage constant current generation circuit includes a reference voltage output circuit which outputs the reference voltage from a reference voltage terminal.

The reference voltage output circuit includes: a third transistor which is connected at a first end thereof to the first potential, and through which a third current flows; a third resistor connected between a second end of the third transistor and the second potential; a fourth transistor which is connected at a first end thereof to the first potential, which is connected at a second end thereof to the reference voltage terminal, and through which a fourth current equivalent to the third current flows; a second diode which is connected at a first end thereof to the second end of the fourth transistor, and which is connected at a second end thereof to the second potential; and a second operational amplifier which is supplied with a voltage between the second end of the third transistor and the third resistor and a voltage between the second end of the fourth transistor and the second diode, and which outputs a second control signal to a control terminal of the third transistor and a control terminal of the fourth transistor.

The first diode is higher than the second diode in capability of letting a current flow with respect to same voltage drop.

Hereafter, a constant voltage constant current generation circuit according, to the present invention will be described more specifically with reference to the drawings.

First Embodiment

Figure 2:
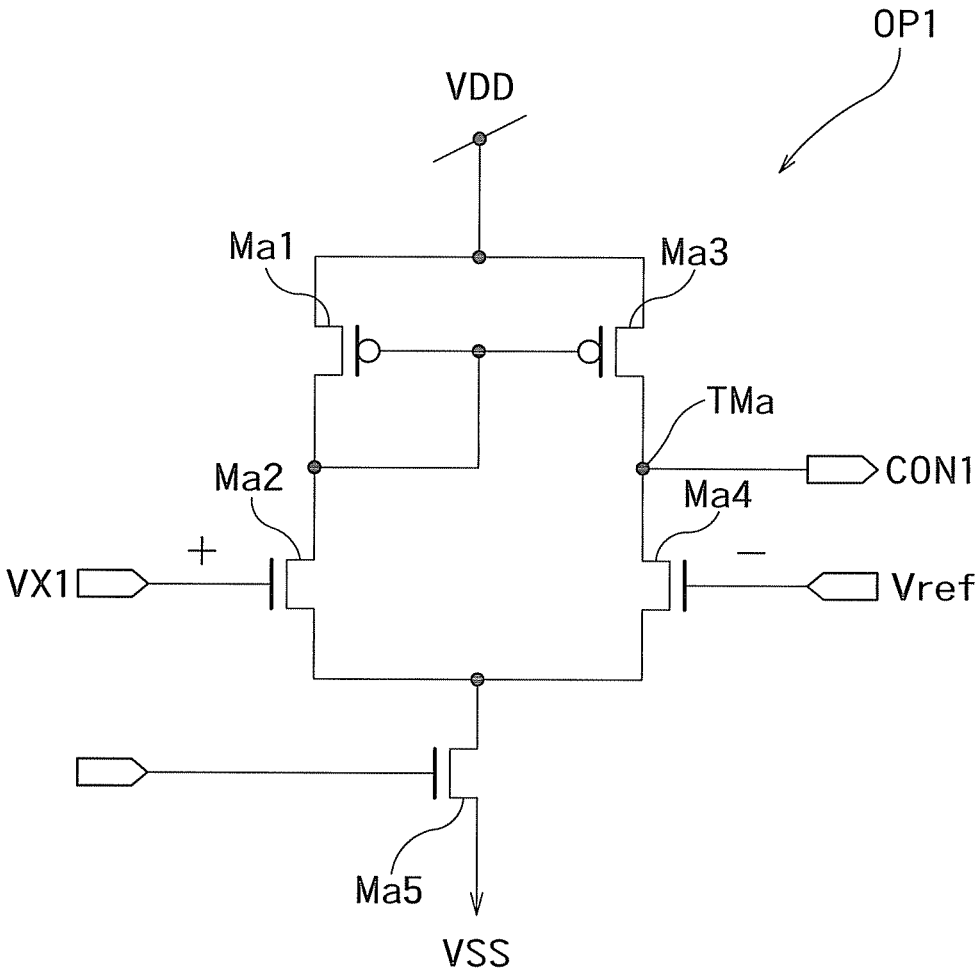
FIG. 2 is a diagram showing an example of a configuration of an operational amplifier OP1 in the constant voltage constant current generation circuit 100 shown in FIG. 1.

FIG. 1 is a diagram showing an example of a circuit configuration of a constant voltage constant current generation circuit 100 according to a first embodiment. FIG. 2 is a diagram showing an example of a configuration of an operational amplifier OP1 in the constant voltage constant current generation circuit 100 shown in FIG. 1.

In the ensuing description, it is supposed that a first potential is a power supply potential and a second potential is a ground potential. If the first potential is the ground potential and the second potential is the power supply potential, polarities of circuits such as transistors in the constant voltage constant current generation circuit 100 become opposite to those in the configuration shown in FIG. 1.

As shown in FIG. 1, the constant voltage constant current generation circuit 100 includes a current output circuit 101, a current source 102, a reference voltage output circuit 103, a first transistor (pMOS transistor) M1, a second transistor (pMOS transistor) M2, a first resistor R1, a second resistor R2, a first diode D1, and a first operational amplifier OP1.

The first transistor M1 is connected at its first end (source) to a power supply potential (a first potential) VDD and connected at its second end (drain) to a first terminal X1.

The first resistor R1 is connected between the first terminal X1 and a ground potential (a second potential) VSS. The first resistor R1 is connected at its first end to the first terminal X1.

The first resistor R1 has positive temperature characteristics. The first resistor R1 is, for example, a diffusion layer or metallic layer formed on a semiconductor substrate (not illustrated).

The first diode D1 is connected between the first terminal X1 and the ground potential VSS in series with the first resistor R1. The first diodes D1 is connected at its anode to a second end of the first resistor R1, and connected at its cathode to the ground potential VSS.

The first diode D1 is formed of, for example, a plurality of (here, N) diodes connected in parallel as shown in FIG. 1.

By the way, the first resistor R1 and the first diode D1 may be interchanged in disposition.

The first operational amplifier OP1 is connected at its noninverting input terminal to the first terminal X1, connected at its inverting input terminal to a reference voltage terminal XVref in a reference voltage output circuit 103, and connected at its output to a control terminal (gate) of the first transistor M1. In other words, the first operational amplifier OP1 is adapted to be supplied at its noninverting input terminal with a voltage VX1 at the first terminal X1, be supplied at its inverting input terminal with a reference voltage Vref, and output a first control signal CON1 to the control terminal (the gate) of the first transistor M1.

The first operational amplifier OP1 outputs the first control signal CON1 to the control terminal (gate) of the first transistor M1 to make the voltage at the first terminal X1 equal to the reference voltage Vref.

As shown in FIG. 2, the first operational amplifier OP1 includes, for example, a first amplifier transistor (pMOS transistor) Ma1, a second amplifier transistor (nMOS transistor) Ma2, a third amplifier transistor (pMOS transistor) Ma3, a fourth amplifier transistor (nMOS transistor) Ma4, and a fifth amplifier transistor (nMOS transistor) Ma5.

The first amplifier transistor Ma1 is connected at its first end (source) to the power supply potential VDD, and is diode-connected.

The second amplifier transistor Ma2 is connected at its first end (drain) to a second end (drain) of the first amplifier transistor and connected at its control terminal (gate) serving as the noninverting input terminal to the first terminal X1. In other words, the voltage VX1 at the first terminal X1 is adapted to be input to the control terminal (gate) of the second amplifier transistor Ma2.

The third amplifier transistor Ma3 is connected at its first end (source) to a power supply potential VDD, connected at its second end (drain) to an output terminal TMa of the first operational amplifier OP1, and connected at its control terminal (gate) to a control terminal (gate) of the first amplifier transistor. The third amplifier transistor Ma3 and the first amplifier transistor Ma1 constitute a mirror circuit.

The fourth amplifier transistor Ma4 is connected at its first end (drain) to a second end (drain) of the third amplifier transistor Ma3, connected at its second end (source) to a second end (source) of the second amplifier transistor Ma2, and connected at its control terminal (gate) serving as an inverting input terminal to the reference voltage terminal XVref (a second end (drain) of a fourth transistor M4). In other words, the fourth amplifier transistor Ma4 is adapted to be supplied at its control terminal (gate) with the voltage Vref at the reference voltage terminal XVref.

The fifth amplifier transistor Ma5 is connected between a second end (drain) of the second amplifier transistor Ma2 and the ground potential VSS. At time of operation, a preset voltage is applied to a control terminal (gate) of the fifth amplifier transistor Ma5 to let a predetermined current (operation current) flow through the fifth amplifier transistor Ma5.

The first operational amplifier OP1 having the configuration described heretofore outputs the first control signal CON1 from the output terminal TMa according to the voltages VX1 and Vref which are input to the control terminals (gates) of the second and fourth amplifier transistors Ma2 and Ma4, respectively.

Furthermore, as shown in FIG. 1, the current output circuit 101 is connected between the power supply potential VDD and the ground potential VSS and adapted to output a constant current Iout from a current output terminal Tiout according to the first control signal CON1.

For example, as shown in FIG. 1, the current output circuit 101 includes a first current output transistor (pMOS transistor) M101*a*, a second current output transistor (nMOS transistor) M101*b*, and a third current output transistor (nMOS transistor) M101*c*.

The first current output transistor M101*a* is connected at its first end (source) to the power supply potential VDD, and connected at its control terminal (gate) to the output terminal of the first operational amplifier OP1. In other words, the first control signal CON1 is input to the control terminal (gate) of the first current output transistor M101*a*, and a current I101 obtained by mirroring a first current I1 which flows through the first transistor M1 flows through the first current output transistor M101*a*.

The second current output transistor M101*b* is connected between a second end (drain) of the first current output transistor M101*a* and the ground potential VSS, and is diode-connected.

The third current output transistor M101*c* is connected between the current output terminal Tiout and the ground potential VSS, and connected at its control terminal (gate) to a control terminal (gate) of the second current output transistor M101*b*. A current obtained by mirroring the current I101 which flows through the second current output transistor M101*b* flows through the third current output transistor M101*c*. The current which flows through the third current output transistor M101*c* becomes a constant current Iout.

Furthermore, as shown in FIG. 1, the second transistor M2 is connected between a voltage output terminal Tvout for outputting a constant voltage Vout and the power supply potential VDD, and connected at its control terminal (gate) to the output terminal of the first operational amplifier OP1. In other words, the first control signal CON1 is input to the control terminal (gate) of the second transistor M2, and a second current I2 obtained by mirroring a first current I1 which flows through the first transistor M1 flows through the second transistor M2.

The second resistor R2 is connected between the voltage output terminal Tvout and the ground potential VSS.

By the way, the second resistor R2 has positive temperature characteristics. The second resistor R2 is, for example, a diffusion layer or metallic layer formed on the semiconductor substrate (not illustrated).

The reference voltage output circuit 103 is adapted to output the reference voltage Vref from the reference voltage terminal XVref.

The reference voltage output circuit 103 includes, for example, a third transistor (pMOS transistor) M3, a fourth transistor (pMOS transistor) M4, a third resistor R3, a second diode D2, and a second operational amplifier OP2 as shown in FIG. 1.

The third transistor M3 is connected at its first end (source) to the power supply potential VDD, connected at its second end (drain) to a second terminal X2, and connected at its control terminal (gate) to an output terminal of the second operational amplifier OP2.

The third resistor R3 is connected between a second end (drain) of the third transistor M3, i.e., the second terminal X2 and the ground potential VSS.

By the way, the third resistor R3 has positive temperature characteristics. The third resistor R3 is, for example, a diffusion layer or metallic layer formed on the semiconductor substrate (not illustrated).

The fourth transistor M4 is connected at its first end (source) to the power supply potential VDD, connected at its second end (drain) to the reference voltage terminal XVref, and connected at its control terminal (gate) to the output terminal of the second operational amplifier OP2 and the control terminal (gate) of the third transistor M3. A second control signal CON2 is input to the control terminal (gate) of the fourth transistor M4. The fourth transistor M4 mirrors a third current I3 which flows through the third transistor M3, and a fourth current I4 which is equal to the third current I3 flows through the fourth transistor M4.

The second diode D2 is connected at its first end (anode) to the second end (drain) of the fourth transistor M4, i.e., the reference voltage terminal XVref, and connected at its second end (cathode) to the ground potential VSS.

By the way, the first diode D1 is set to be higher than the second diode D2 in capability of letting flow a current with respect to the same voltage drop. For example, therefore, the first diode D1 is set to be greater than the second diode D2 in size. For example, the size of each of N diodes which constitute the first diode D1 is set to be the same as the size of the second diode D2. In this case, the first diode D1 has a size which is N times as large as that of the second diode D2.

Furthermore, the second operational amplifier OP2 is connected at its inverting input terminal to the reference voltage terminal XVref (the second end (drain) of the fourth transistor M4), connected at its noninverting input terminal to the second terminal X2 between the second end (drain) of the third transistor M3 and the third resistor R3, and connected at its output to the control terminals (gates) of the third and fourth transistors M3 and M4.

In other words, the voltage VX2 at the second terminal X2 between the second end (drain) of the third transistor M3 and the third resistor R3 and the voltage (the reference voltage Vref) between the second end (drain) of the fourth transistor M4 and the second diode D2 are input to the second operational amplifier OP2. The second operational amplifier OP2 outputs the second control signal CON2 to the control terminal (gate) of the third transistor M3 and the control terminal (gate) of the fourth transistor M4.

The second operational amplifier OP2 outputs the second control signal CON2 to the control terminal (gate) of the third transistor M3 and the control terminal (gate) of the fourth transistor M4 to make the voltage VX2 between the second end (drain) of the third transistor M3 and the third resistor R3 equal to the voltage Vref between the second end (drain) of the fourth transistor M4 and the second diode D2.

By the way, the second operational amplifier OP2 has, for example, a circuit configuration similar to that of the first operational amplifier OP1 shown in FIG. 2.

As shown in FIG. 1, the current source 102 is connected between the power supply potential VDD and the voltage output terminal Tvout. The current source 102 outputs a current I102 to the voltage output terminal Tvout. The output current of the current source 102 decreases as the temperature rises, whereas the output current of the current source 102 increases as the temperature falls. In this way, the current source 102 has negative current characteristics with respect to the temperature change.

The current source 102 is formed of, for example, a current source transistor (pMOS transistor) M102 as shown in FIG. 1. The current source transistor M102 is connected at its first end (source) to the power supply potential VDD, connected at its second end (drain) to the voltage output terminal Vout, and connected at its control terminal (gate) to the output terminal of the second operational amplifier OP2. In other words, the second control signal CON2 is input to the control terminal (gate) of the current source transistor M102. The current I102 obtained by mirroring the third current I3 which flows through the third transistor M3 flows through the current source transistor M102 according to the second control signal CON2. In other words, the current I102 is a current obtained by mirroring the third current I3 which has negative current characteristics with respect to the temperature change, and has negative current characteristics with respect to the temperature change.

A current obtained by summing up the current I102 and the second current I2 which flows through the second transistor M2 flows through the second resistor R2.

By the way, the current source 102 may be controlled to have negative current characteristics with respect to the temperature change by another control signal instead of the second control signal CON2.

Operation characteristics of the constant voltage constant current generation circuit 100 having the configuration described heretofore will now be described.

Figure 3:
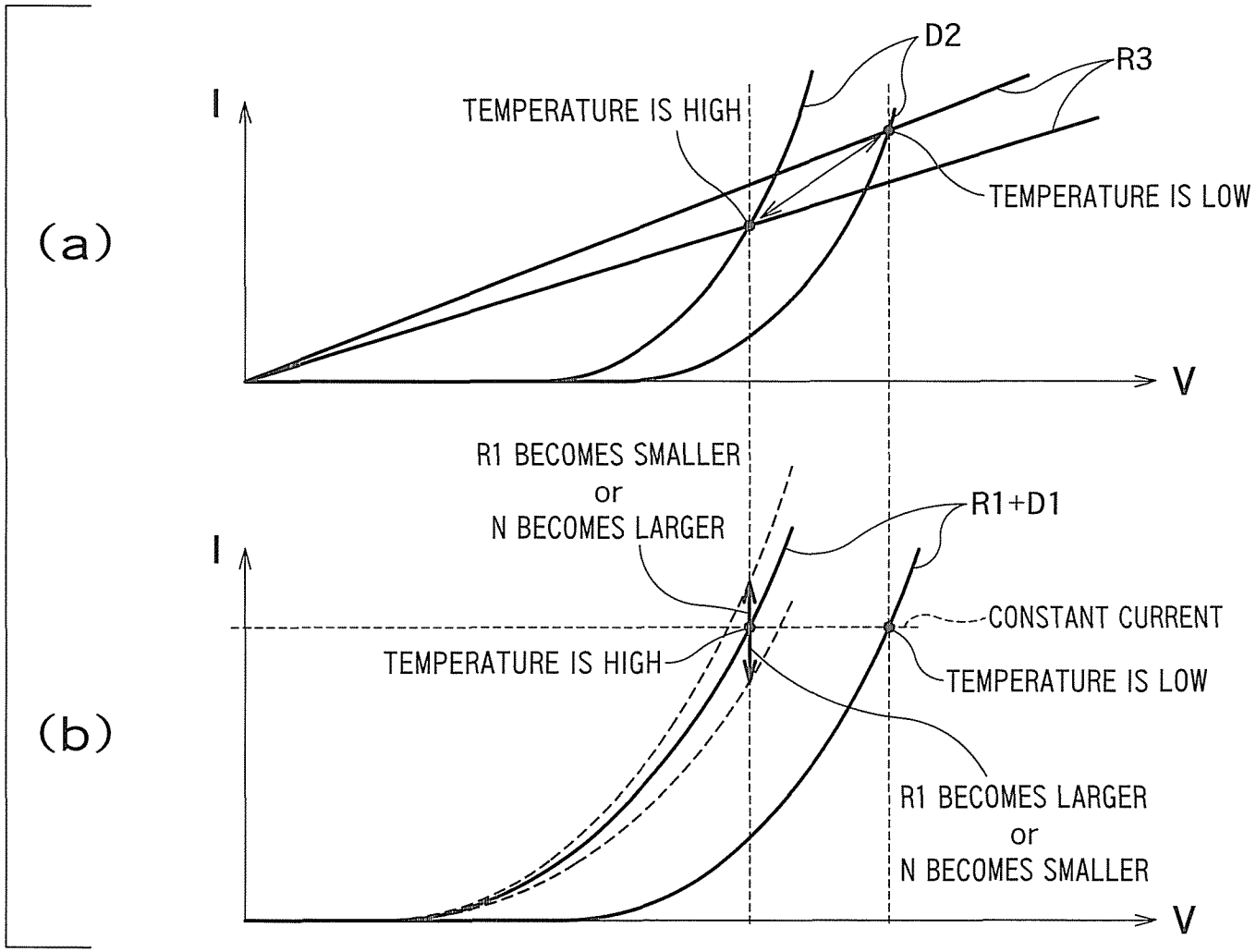
FIG. 3 is a diagram showing an example of voltage current characteristics to explain the operation characteristics of the constant voltage constant current generation circuit 100 shown in FIG. 1.

FIG. 3 is a diagram showing an example of voltage current characteristics to explain the operation characteristics of the constant voltage constant current generation circuit 100 shown in FIG. 1. FIG. 3(*a*) shows IV curves of the third resistor R3 and IV curves of the second diode D2 when the temperature is low and when the temperature is high. FIG. 3(*b*) shows IV curves of the circuit formed of the first resistor R1 and the first diode D1 connected in series when the temperature is low and when the temperature is high.

As shown in FIG. 3(*a*), the resistance value of the third resistor R3 has positive temperature characteristics. On the other hand, the inter-terminal voltage of the second diode D2 has negative temperature characteristics. In the reference voltage output circuit 103, control is exercised to make the current flowing through the second diode D2 and the voltage across the second diode D2 equal to the current flowing through the third resistor R3 and the voltage across the third resistor R3, respectively. As shown in FIG. 3(*a*), therefore, the current flowing through the second diode D2 and the third resistor R3 decreases as the temperature rises. On the other hand, the current flowing through the second diode D2 and the third resistor R3 increases as the temperature falls. In the same way, the voltage across the second diode D2 and the third resistor R3 decreases as the temperature rises. On the other hand, the voltage across the second diode D2 and the third resistor R3 increases as the temperature falls.

On the other hand, as shown in FIG. 3(*b*), the first current I1 flowing through the circuit (R1+D1) formed of the first resistor R1 and the first diode D1 connected in series is controlled to be constant even if the temperature changes, by operation of the first operational amplifier OP1 which forms a negative feedback circuit.

By the way, the first current I1 can be increased by decreasing the resistance value of the first resistor R1 or increasing the number N of diodes included in the first diode D1. On the other hand, the first current I1 can be decreased by increasing the resistance value of the first resistor R1 or decreasing the number N of diodes included in the first diode D1.

In this way, the first current I1 is kept constant even if the temperature changes. Therefore, the output current Tout obtained by mirroring the first current I1 is kept constant even if the temperature changes.

The current I2 flowing through the second resistor R2 is the current obtained by mirroring the first current I1 which is kept constant even if the temperature changes as described above. Therefore, if the current I2 flowing through the second resistor R2 is kept constant even if the temperature changes. On the other hand, the current I102 which is output from the current source 102 has negative current characteristics with respect to the temperature change.

The current obtained by summing up the current I102 and the second current I2 flowing through the second transistor M2 flows through the second resistor R2. Therefore, the summed up current has negative current characteristics with respect to the temperature. On the other hand, the second resistor R2 has positive temperature characteristics as already described.

In other words, the output voltage Vout which is the voltage drop caused across the second resistor R2 by the summed up current is kept constant with respect to the temperature change because the negative current characteristics of the summed up current and the positive temperature characteristics of the second resistor R2 cancel each other.

Owing to the operation characteristics of the constant voltage constant current generation circuit 100 described heretofore, both a constant current and a constant voltage with respect to the temperature change can be generated.

As for elements which form the constant voltage constant current generation circuit 100, resistors of three kinds and diodes of two kinds are used. The circuit can be formed with as many elements as in the ordinary BGR circuit. As compared with the case where both the constant current and the constant voltage are generated individually, the area of the circuit and the power dissipation can be reduced to approximately half. By the way, the number of amplifiers is two, which is equivalent to the case where the two circuits are formed.

According to the constant voltage constant current generation circuit in the present embodiment, the area of the circuit can be reduced while generating the constant voltage and the constant current regardless of the temperature change.

Second Embodiment

In the present second embodiment, another example of the configuration of the reference voltage output circuit 103 will be described. Its configuration except the reference voltage output circuit 103 is the same as that in the constant voltage constant current generation circuit 100 according to the first embodiment shown in FIG. 1.

Figure 4:
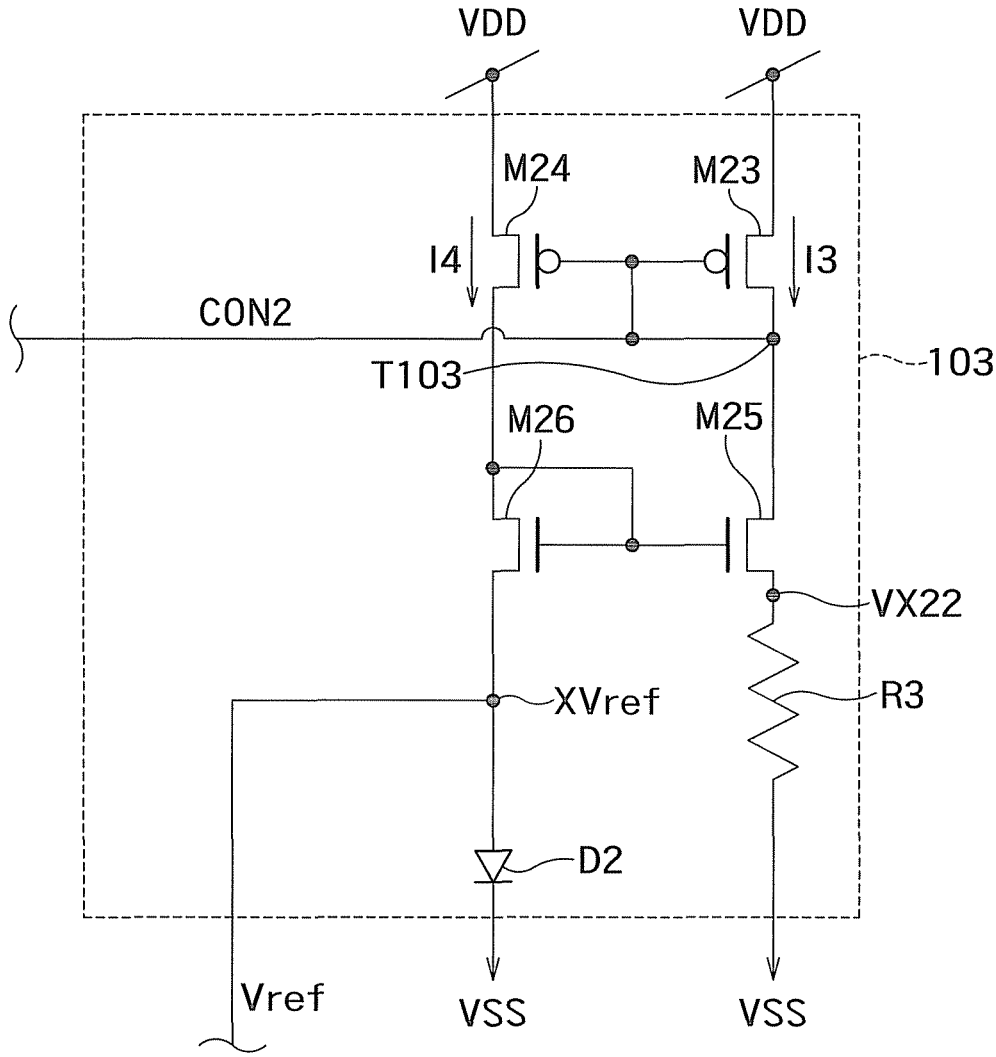
FIG. 4 is a circuit diagram showing another example of the configuration of the reference voltage output circuit 103 in the constant voltage constant current generation circuit 100 shown in FIG. 1.

FIG. 4 is a circuit diagram showing another example of the configuration of the reference voltage output circuit 103 in the constant voltage constant current generation circuit 100 shown in FIG. 1. In FIG. 4, the same reference numerals as those in FIG. 1 denote components which are like those in the first embodiment.

As shown in FIG. 4, the reference voltage output circuit 103 includes a third transistor (pMOS transistor) M23, a fourth transistor (pMOS transistor) M24, a fifth transistor (nMOS transistor) M25, a sixth transistor (nMOS transistor) M26, a third resistor R3, and a second diode D2.

The third transistor M23 is diode-connected, and connected at its first end (source) to the power supply potential VDD, connected at its second end (drain) to an output terminal T103, and connected at its control terminal (gate) to the output terminal T103 which outputs the second control signal CON2.

By the way, the output terminal T103 is connected to the control terminal (gate) of the current source transistor M102 in the current source 102 shown in FIG. 1. In other words, the reference voltage output circuit 103 is adapted to output the second control signal CON2 from the second end (drain) of the third transistor M23.

The fourth transistor M24 is connected at its first end (source) to the power supply potential VDD, and connected at its control terminal (gate) to the control terminal (gate) of the third transistor M23. The fourth transistor M24 mirrors the third current I3 which flows through the third transistor M23, and a fourth current I4 which is equal to the third current I3 flows through the fourth transistor M24.

The fifth transistor M25 is connected at its first end (drain) to the second end (drain) of the third transistor M23.

The sixth transistor M26 is diode-connected, connected at its first end (drain) to a second end (drain) of the fourth transistor M24, connected at its control terminal (gate) to a control terminal (gate) of the fifth transistor M25, and connected at its second end (source) to the reference voltage terminal XVref. The sixth transistor M26 constitutes a mirror circuit in conjunction with the fifth transistor M25, and a mirror current of the sixth transistor M26 is let flow through the fifth transistor M25.

The third resistor R3 is connected between a second end (source) of the fifth transistor M25 and the ground potential VSS.

The second diode D2 is connected at its first end (anode) to a second end (source) of the sixth transistor M26, and connected at its second end (cathode) to the ground potential VSS.

The reference voltage output circuit 103 having such a configuration is set to make the third current I3 equal to the fourth current I4. A voltage VX22 between the second end (source) of the fifth transistor M25 and the third resistor R3 becomes equal to the voltage Vref between the second end (source) of the sixth transistor M26 and the second diode D2.

Operation characteristics of the constant voltage constant current generation circuit 100 are similar to those in the first embodiment.

In other words, the output voltage Vout which is the voltage drop caused across the second resistor R2 by the summed up current is kept constant with respect to the temperature change because the negative current characteristics of the summed up current and the positive temperature characteristics of the second resistor R2 cancel each other.

Owing to the operation characteristics of the constant voltage constant current generation circuit 100 described heretofore, both a constant current and a constant voltage with respect to the temperature change can be generated as in the first embodiment.

As for elements which form the constant voltage constant current generation circuit 100, resistors of three kinds and diodes of two kinds are used. The circuit can be formed with as many elements as in the ordinary BGR circuit. As compared with the case where both the constant current and the constant voltage are generated individually, the area of the circuit and the power dissipation can be reduced to approximately half. In addition, the number of amplifiers can be made equal to one.

According to the constant voltage constant current generation circuit in the present second embodiment, the area of the circuit can be reduced while generating the constant voltage and the constant current regardless of the temperature change as in the first embodiment.

In the embodiments already described, the case where MOS transistors are used as transistors has been described.

However, bipolar transistors may be used as the transistors. Transistors corresponding to the pMOS transistors become PNP bipolar transistors, and transistors corresponding to the nMOS transistors become NPN bipolar transistors. In this case, the control terminals correspond to bases.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A constant voltage constant current generation circuit comprising: a first transistor connected at a first end thereof to a first potential and connected at a second end thereof to a first terminal; a first resistor connected between the first terminal and a second potential; a first diode connected in series with the first resistor between the first terminal and the second potential; a first operational amplifier which is supplied with a voltage at the first terminal and a reference voltage, and which outputs a first control signal to a control terminal of the first transistor; a current output circuit which is connected between the first potential and the second potential, and which outputs a constant current from a current output terminal according to the first control signal; a second transistor which is connected between a voltage output terminal for outputting a constant voltage and the first potential, which is supplied at a control terminal thereof with the first control signal, and through which a second current flows, the second current obtained by minoring a first current flowing through the first transistor; a second resistor connected between the voltage output terminal and the second potential; a current source which is connected between the first potential and the voltage output terminal, which outputs a current to the voltage output terminal, and which has negative current characteristics with respect to a temperature change; and a reference voltage output circuit which outputs the reference voltage from a reference voltage terminal, wherein the reference voltage output circuit comprises: a third transistor which is connected at a first end thereof to the first potential, and through which a third current flows; a third resistor connected between a second end of the third transistor and the second potential; a fourth transistor which is connected at a first end thereof to the first potential, which is connected at a second end thereof to the reference voltage terminal, and through which a fourth current equivalent to the third current flows; a second diode which is connected at a first end thereof to the second end of the fourth transistor, and which is connected at a second end thereof to the second potential; and a second operational amplifier which is supplied with a voltage between the second end of the third transistor and the third resistor and a voltage between the second end of the fourth transistor and the second diode, and which outputs a second control signal to a control terminal of the third transistor and a control terminal of the fourth transistor, the first diode being higher than the second diode in capability of letting a current flow with respect to same voltage drop.

2. The constant voltage constant current generation circuit according to claim 1, wherein the current source is a current source transistor, the current source transistor connected at a first end thereof to the first potential, connected at a second end thereof to the voltage output terminal, and supplied at a control terminal thereof with the second control signal, and a current flowing through the current source transistor which is obtained by minoring the third first current flowing through the third transistor.

3. The constant voltage constant current generation circuit according to claim 1, wherein the first resistor is connected at a first end thereof to the first potential, and the first diode is connected between a second end of the first resistor and the second potential.

4. The constant voltage constant current generation circuit according to claim 1, wherein the current output circuit comprises: a first current output transistor which is connected at a first end thereof to the first potential, which is supplied at a control terminal thereof with the first control signal, and through which a current obtained by minoring a first current flows, the first current flowing through the first transistor; a second current output transistor which is connected between a second end of the first current output transistor and the second potential, and which is diode-connected; and a third current output transistor which is connected between the current output terminal and the second potential, which is connected at control terminal thereof to a control terminal of the second current output transistor, and through which a current obtained by mirroring a current flowing through the second transistor flows.

5. The constant voltage constant current generation circuit according to claim 1, wherein the first potential is a power supply potential, the second potential is a ground potential, the first to fourth transistors are pMOS transistors, the first operational amplifier is connected at a noninverting input terminal thereof to the first terminal, and is connected at an inverting input terminal thereof to the reference voltage terminal, and the second operational amplifier is connected at a noninverting input terminal thereof to the second end of the fourth transistor, and is connected at an inverting input terminal thereof to the second end of the third transistor.

6. The constant voltage constant current generation circuit according to claim 5, wherein the first resistor is connected at a first end thereof to the first potential, the first diode is connected at a anode thereof to a second end of the first resistor, and is connected at a cathode thereof to the second potential, and the second diode is connected at an anode thereof to the reference voltage terminal, and connected at a cathode thereof to the second potential.

7. The constant voltage constant current generation circuit according to claim 1, wherein the first operational amplifier comprises: a first amplifier transistor which is connected at a first end thereof to the first potential, and which is diode-connected; a second amplifier transistor which is connected at a first end thereof to a second end of the first amplifier transistor, and which is supplied at a control terminal thereof with a voltage at the first terminal; a third amplifier transistor which is connected at a first end thereof to the first potential, which is connected at a second end thereof to an output terminal of the first operational amplifier, and which is connected at a control terminal thereof to a control terminal of the first amplifier transistor; a fourth amplifier transistor which is connected at a first end thereof to the second end of the third amplifier transistor, which is connected at a second end thereof to a second end of the second amplifier transistor, and which is supplied at a control terminal thereof with the reference voltage; and a fifth amplifier transistor which is connected between the second end of the second amplifier transistor and the second potential, which is supplied at a control terminal thereof with a preset voltage, and through which a predetermined current flows.

8. The constant voltage constant current generation circuit according to claim 1, wherein the first operational amplifier outputs the first control signal to the control terminal of the first transistor to make a voltage at the first terminal equal to the reference voltage.

9. The constant voltage constant current generation circuit according to claim 1, wherein the second operational amplifier outputs the second control signal to the control terminal of the third transistor and the control terminal of the fourth transistor to make a voltage between the second end of the third transistor and the third resistor equal to a voltage between the second end of the fourth transistor and the second diode.

10. The constant voltage constant current generation circuit according to claim 1, wherein the first potential is a power supply potential, the second potential is a ground potential, the first and second transistors are pMOS transistors, and the first operational amplifier is connected at a noninverting input terminal thereof to the first terminal, and is connected at an inverting input terminal thereof to the reference voltage terminal.

11. A constant voltage constant current generation circuit comprising: a first transistor connected at a first end thereof to a first potential and connected at a second end thereof to a first terminal; a first resistor connected between the first terminal and a second potential; a first diode connected in series with the first resistor between the first terminal and the second potential; a first operational amplifier which is supplied with a voltage at the first terminal and a reference voltage, and which outputs a first control signal to a control terminal of the first transistor; a current output circuit which is connected between the first potential and the second potential, and which outputs a constant current from a current output terminal according to the first control signal; a second transistor which is connected between a voltage output terminal for outputting a constant voltage and the first potential, which is supplied at a control terminal thereof with the first control signal, and through which a second current flows, the second current obtained by minoring a first current flowing through the first transistor; a second resistor connected between the voltage output terminal and the second potential; a current source which is connected between the first potential and the voltage output terminal, which outputs a current to the voltage output terminal, and which has negative current characteristics with respect to a temperature change; and a reference voltage output circuit which outputs the reference voltage from a reference voltage terminal, wherein the reference voltage output circuit comprises: a third transistor which is connected at a first end thereof to the first potential, and which is diode-connected; a fourth transistor which is connected at a first end thereof to the first potential, and through which a fourth current flows, the fourth current obtained by minoring a third current flowing through the third transistor, and the fourth current being equal to a third current; a fifth transistor which is connected at a first end thereof to a second end of the third transistor; a sixth transistor which is connected at a first end thereof to a second end of the fourth transistor, which is connected at a second end thereof to the reference voltage terminal, and which is diode-connected; a third resistor connected between a second end of the fifth transistor and the second potential; and a second diode which is connected at a first end thereof to the second end of the sixth transistor, and which is connected at a second end thereof to the second potential, the reference voltage output circuit outputting a second control signal from the second end of the third transistor, the fifth transistor through which a current, obtained by minoring the fourth current flowing through the sixth transistor, flows, and the first diode being higher than the second diode in capability of letting a current flow with respect to same voltage drop.

12. The constant voltage constant current generation circuit according to claim 11, wherein the current source is a current source transistor, the current source transistor connected at a first end thereof to the first potential, connected at a second end thereof to the voltage output terminal, and supplied at a control terminal thereof with the second control signal, and a current flowing through the current source transistor which is obtained by mirroring the third first current flowing through the third transistor.

13. The constant voltage constant current generation circuit according to claim 11, wherein the first resistor is connected at a first end thereof to the first potential, and the first diode is connected between a second end of the first resistor and the second potential.

14. The constant voltage constant current generation circuit according to claim 11, wherein the current output circuit comprises: a first current output transistor which is connected at a first end thereof to the first potential, which is supplied at a control terminal thereof with the first control signal, and through which a current obtained by mirroring a first current flows, the first current flowing through the first transistor; a second current output transistor which is connected between a second end of the first current output transistor and the second potential, and which is diode-connected; and a third current output transistor which is connected between the current output terminal and the second potential, which is connected at control terminal thereof to a control terminal of the second current output transistor, and through which a current obtained by mirroring a current flowing through the second transistor flows.

15. The constant voltage constant current generation circuit according to claim 11, wherein the first potential is a power supply potential, the second potential is a ground potential, the first to fourth transistors are pMOS transistors, and the first operational amplifier is connected at a noninverting input terminal thereof to the first terminal, and is connected at an inverting input terminal thereof to the reference voltage terminal.

16. The constant voltage constant current generation circuit according to claim 15, wherein the first resistor is connected at a first end thereof to the first potential, the first diode is connected at a anode thereof to a second end of the first resistor, and is connected at a cathode thereof to the second potential, and the second diode is connected at an anode thereof to the reference voltage terminal, and connected at a cathode thereof to the second potential.

17. The constant voltage constant current generation circuit according to claim 11, wherein the first operational amplifier comprises: a first amplifier transistor which is connected at a first end thereof to the first potential, and which is diode-connected; a second amplifier transistor which is connected at a first end thereof to a second end of the first amplifier transistor, and which is supplied at a control terminal thereof with a voltage at the first terminal; a third amplifier transistor which is connected at a first end thereof to the first potential, which is connected at a second end thereof to an output terminal of the first operational amplifier, and which is connected at a control terminal thereof to a control terminal of the first amplifier transistor; a fourth amplifier transistor which is connected at a first end thereof to the second end of the third amplifier transistor, which is connected at a second end thereof to a second end of the second amplifier transistor, and which is supplied at a control terminal thereof with the reference voltage; and a fifth amplifier transistor which is connected between the second end of the second amplifier transistor and the second potential, which is supplied at a control terminal thereof with a preset voltage, and through which a predetermined current flows.

18. The constant voltage constant current generation circuit according to claim 11, wherein the first operational amplifier outputs the first control signal to the control terminal of the first transistor to make a voltage at the first terminal equal to the reference voltage.

* * * * *